US009612087B2

(12) United States Patent
Summers et al.

(10) Patent No.: US 9,612,087 B2
(45) Date of Patent: Apr. 4, 2017

(54) SLIDING ARCHERY SIGHT

(71) Applicant: Gregory E. Summers, Madison Heights, VA (US)

(72) Inventors: Gregory E. Summers, Amherst, VA (US); Tristan Mason, Madison Heights, VA (US); Daniel E. Ellgass, Lynchbrug, VA (US)

(73) Assignee: Gregory E. Summers, Madison Heights, VA (US)

( * ) Notice: Subject to any disclaimer, the term of this patent is extended or adjusted under 35 U.S.C. 154(b) by 149 days.

(21) Appl. No.: 14/531,159

(22) Filed: Nov. 3, 2014

(65) Prior Publication Data

US 2015/0135579 A1 May 21, 2015

Related U.S. Application Data

(60) Provisional application No. 61/906,149, filed on Nov. 19, 2013.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265
See application file for complete search history.

(56) References Cited

U.S. PATENT DOCUMENTS 5,289,814 A * 3/1994 Maisano ..... F41G 1/467 124/87
5,384,966 A * 1/1995 Gibbs ..... F41G 1/467 124/87
5,560,113 A * 10/1996 Simo ..... F41G 1/467 124/87
6,463,665 B1 * 10/2002 Gomez-Vazquez ..... F41G 1/467 124/87
7,574,811 B2 * 8/2009 Kurtzhals ..... F41G 1/467 124/87
7,610,686 B1 * 11/2009 Summers ..... F41G 1/467 124/87
8,161,656 B1 * 4/2012 Ellgass ..... F41G 1/467 124/87
8,622,051 B2 * 1/2014 Summers ..... F41B 5/1469 124/35.2
8,713,807 B2 * 5/2014 LoRocco ..... F41G 1/345 124/87
9,097,491 B2 * 8/2015 Summers ..... F41G 1/467
(Continued)

*Primary Examiner* — Yaritza Guadalupe-McCall
(74) *Attorney, Agent, or Firm* — Leading-Edge Law Group, PLC

(57) ABSTRACT

An adjustable mechanism for an archery sight is characterized by a unique elevation and tension adjustment assemblies which allow a user to quickly and easily set the sight for optimum performance. The mechanism includes an elevation base having an elevation rail and carriage assembly connected therewith for sliding movement along the base in a first direction. A windage carriage is connected with the elevation carriage for movement in a second direction, and a sight is connected with the windage carriage. A tension assembly including a unique traction wheel, yoke and cam mechanism is provided for adjusting the tension between the rail and the base, and an adjustable detent assembly is provided to stop movement of the elevation rail and carriage in selected elevation locations relative to the base.

16 Claims, 8 Drawing Sheets

(56) References Cited

U.S. PATENT DOCUMENTS

| | | | | |
|---|---|---|---|---|
| 9,285,183 | B2 * | 3/2016 | Rentz | F41B 5/1469 |
| 2004/0205971 | A1 * | 10/2004 | Terry | F41G 1/467 33/265 |
| 2009/0000134 | A1 * | 1/2009 | Kurtzhals | F41G 1/467 33/265 |
| 2011/0277329 | A1 * | 11/2011 | Summers | F41G 1/467 33/265 |
| 2015/0082643 | A1 * | 3/2015 | Summers | F41G 1/467 33/265 |
| 2015/0135579 | A1 * | 5/2015 | Summers | F41G 1/467 42/130 |

* cited by examiner

SLIDING ARCHERY SIGHT

This application claims the benefit of U.S. provisional application No. 61/906,149 filed Nov. 19, 2013.

BACKGROUND OF THE INVENTION

Sight devices such as those used in archery must be adjustable to fit the user precisely to provide maximum accuracy, particularly where the sight is used in tournaments or other competition. Sights are normally adjustable in three dimensions, with the most important adjustment being in elevation. The present invention relates to an improved elevation adjustment mechanism and tension assembly which allows quick and efficient adjustment of the sight holder relative to an archery bow.

BRIEF DESCRIPTION OF THE PRIOR ART

Many archers attempt to mount their sight approximately thirty inches from their anchor point. A sight bracket is mounted on the bow and an extension bar is connected with the mounting bracket. The extension bar generally extends horizontally when the bow is in use. An elevation bar is connected with the extension bar and is generally perpendicular relative to the elevation bar so that it extends vertically when the bow is in use. A carriage is arranged on the elevation bar and a sight is connected with the carriage. The carriage is displaced by the user along the elevation bar to precisely position the sight at the optimum position. Displacement of the carriage is usually done incrementally, which can be time consuming where more than fine tuning adjustment is required such as where different target distances are used in a tournament. Moreover, conventional adjustment mechanisms do not provide the user with the ability to adjust and lock the tension of elevation travel between the carriage and the elevation bar.

The Summers et al U.S. patent application Ser. No. 14/034,035 discloses an elevation adjustment mechanism for a sight in which an elongated screw is used to displace a carriage for a sight on an elevation bar connected with a bow. A pivot nut is used to connect the carriage with the screw so that the carriage may be engaged with or released from the screw. A tension system is provided to adjust the tension between the carriage and the elevation bar so that the user may adjust the freedom of movement of the carriage.

While the prior devices operate satisfactorily, they may be compromised by forward and backward bow forces that occur during the bow firing sequence. In addition, prior devices do not provide yardage selectable positions for the sight which can be adjusted and set by the user.

The present invention was developed in order to overcome these and other drawbacks of the prior adjustment devices by providing an elevation adjustment mechanism capable of adjustment of the elevation carriage and sight to desired positions and improved tension adjustment between the carriage and the elevation base.

SUMMARY OF THE INVENTION

A sight elevation assembly for a bow includes a variable tension assembly. The variable tension assembly includes a tension lever having a cam surface. A yoke is connected with the elevation assembly and the cam surface engages the yoke. Rotation of the tension lever in opposite directions displaces the yoke to increase and decrease the tension applied to the elevation assembly. The tension lever passes through an adjustment plate which controls the range of rotation of the lever to limit rotation of the lever between low and high tension positions, respectively.

The sight elevation assembly includes a base connected with a bow mount. A rail is slidably connected with the base for linear movement relative thereto. The tension assembly is connected between the rail and the base to vary the tension between the rail and base. A traction wheel is supported by the yoke and engages a portion of the rail so that rotation of the traction wheel displaces the rail relative to the base. The traction wheel has a knurled surface and the rail is formed of a synthetic plastic material which is imprinted by the tension wheel surface when the tension wheel is pressed against a surface of the rail by the tension assembly.

An elevation carriage is connected with the rail and a detent assembly is connected with the base and the elevation carriage for retaining the carriage in at least one linear position relative to the base corresponding to a desired elevation of the sight. The detent assembly includes at least one detent adjustably connected with the base and at least one housing adjustably connected with the carriage. The base includes side walls each of which contain a longitudinal slot in the upper portion thereof. The detents are arranged in the slots for sliding movement along the base. Each detent includes a screw which is operable to fix the detents in the desired position corresponding to an elevation selected by the user.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
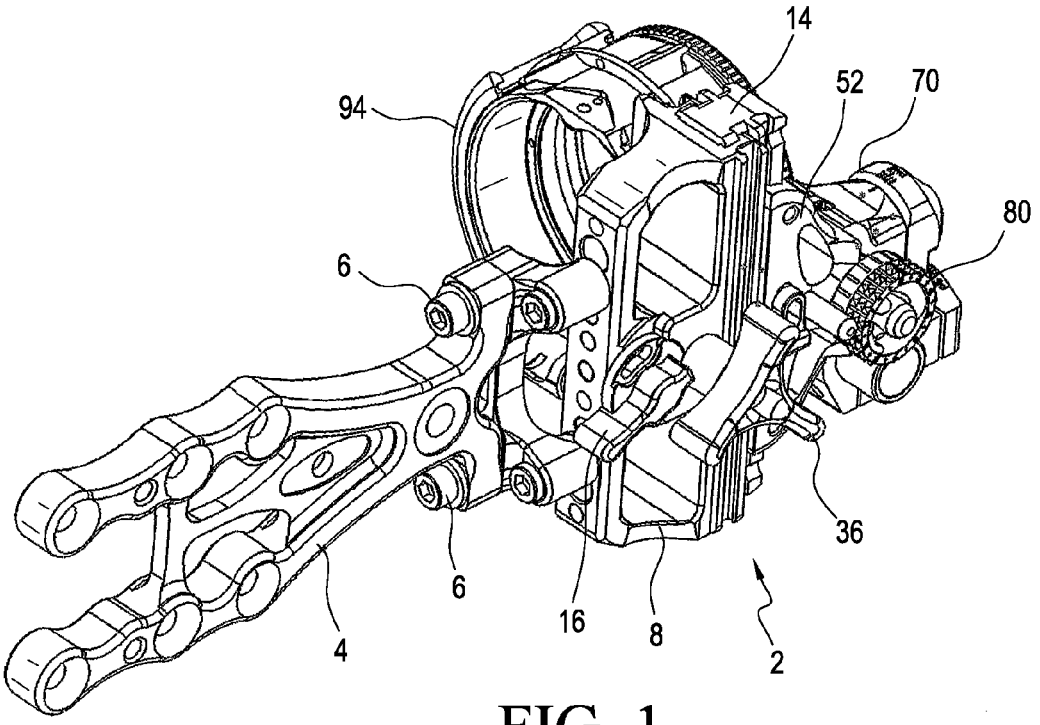
FIGS. 1 and 2 are front and rear a perspective views, respectively, of an elevation adjustment assembly for a sight connected with an extension bar for mounting on a bow.
Figure 2:
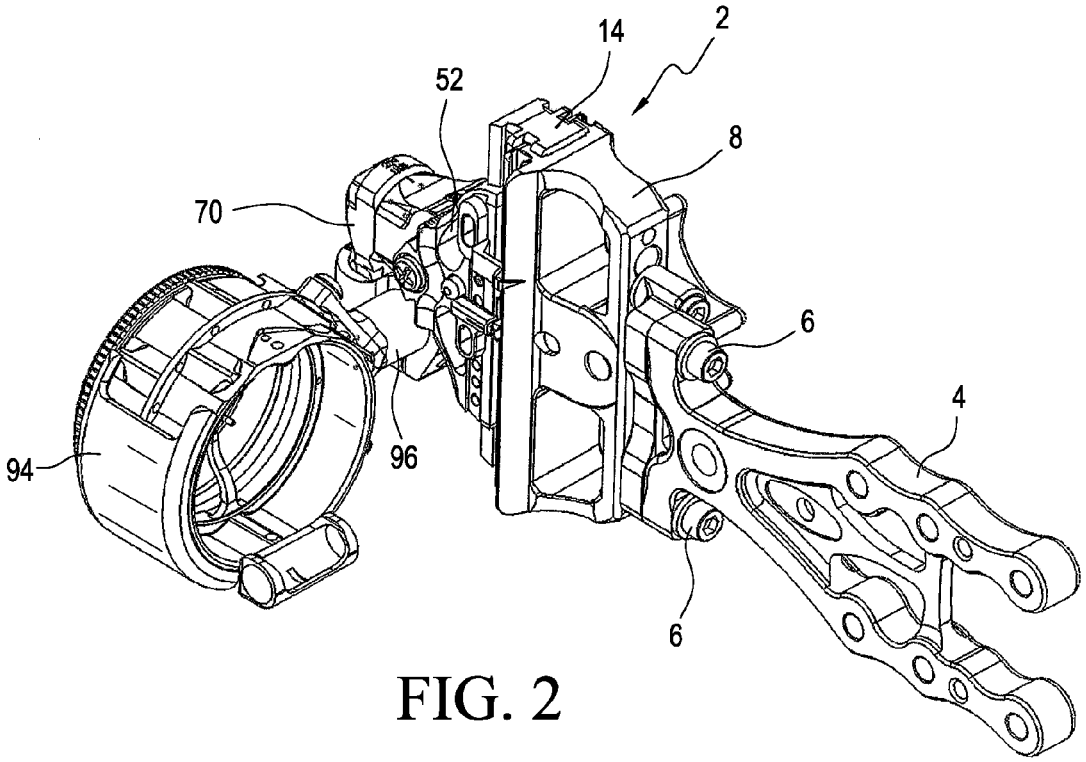

Referring first to FIGS. 1 and 2, the sliding archery sight elevation adjustment mechanism is shown. The elevation adjustment mechanism 2 is connected with an extension bar 4 via screws 6 or other suitable fasteners. The extension bar is attached to a bow (not shown). In use, the extension bar generally extends horizontally and the elevation adjustment mechanism extends vertically, with the sight being adjusted for elevation along an elevation base 8.

Figure 3:
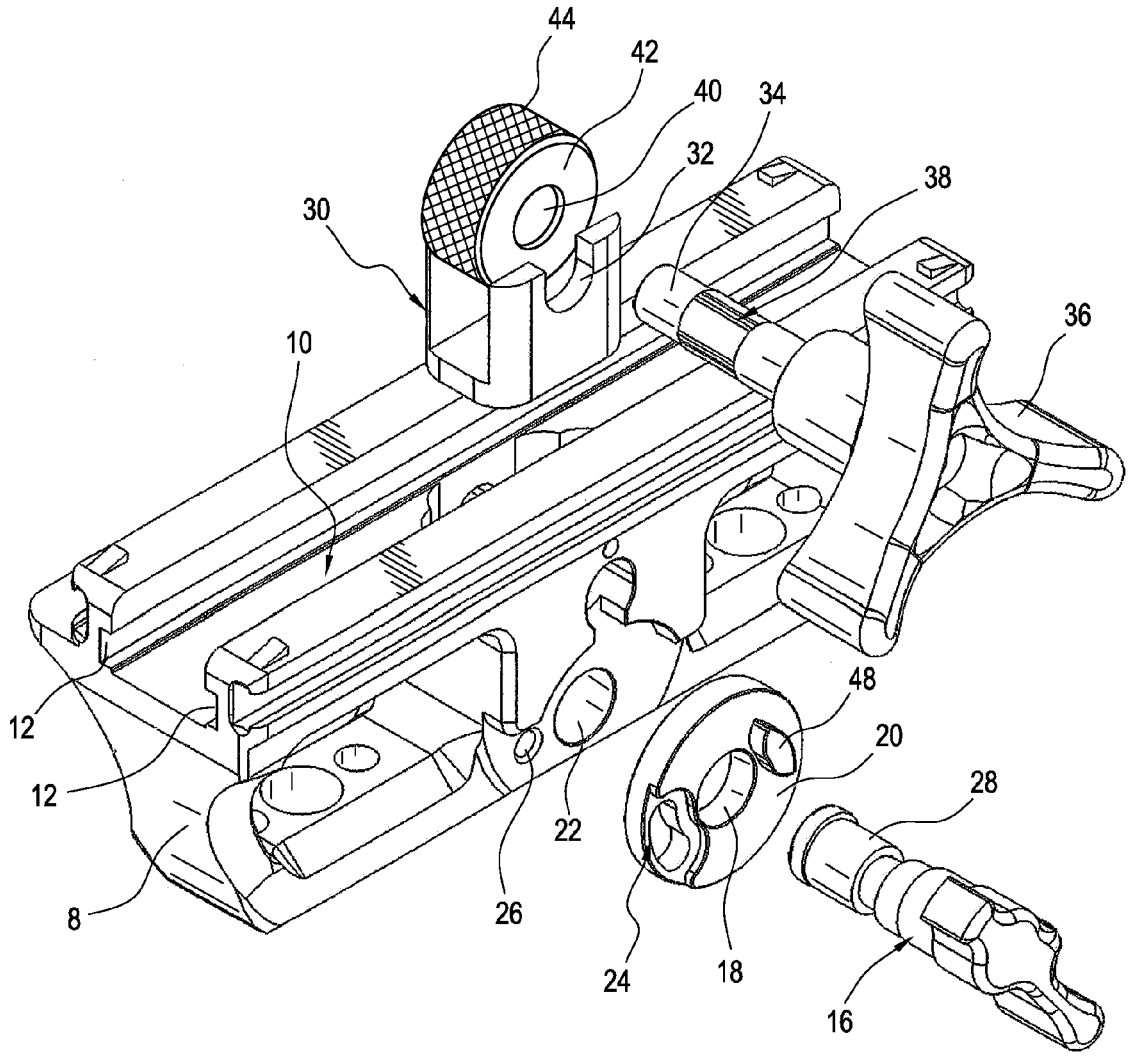
FIG. 3 is a detailed exploded perspective view of the elevation base and tension adjustment assembly for the elevation adjustment assembly shown in FIG. 1.
Figure 4:
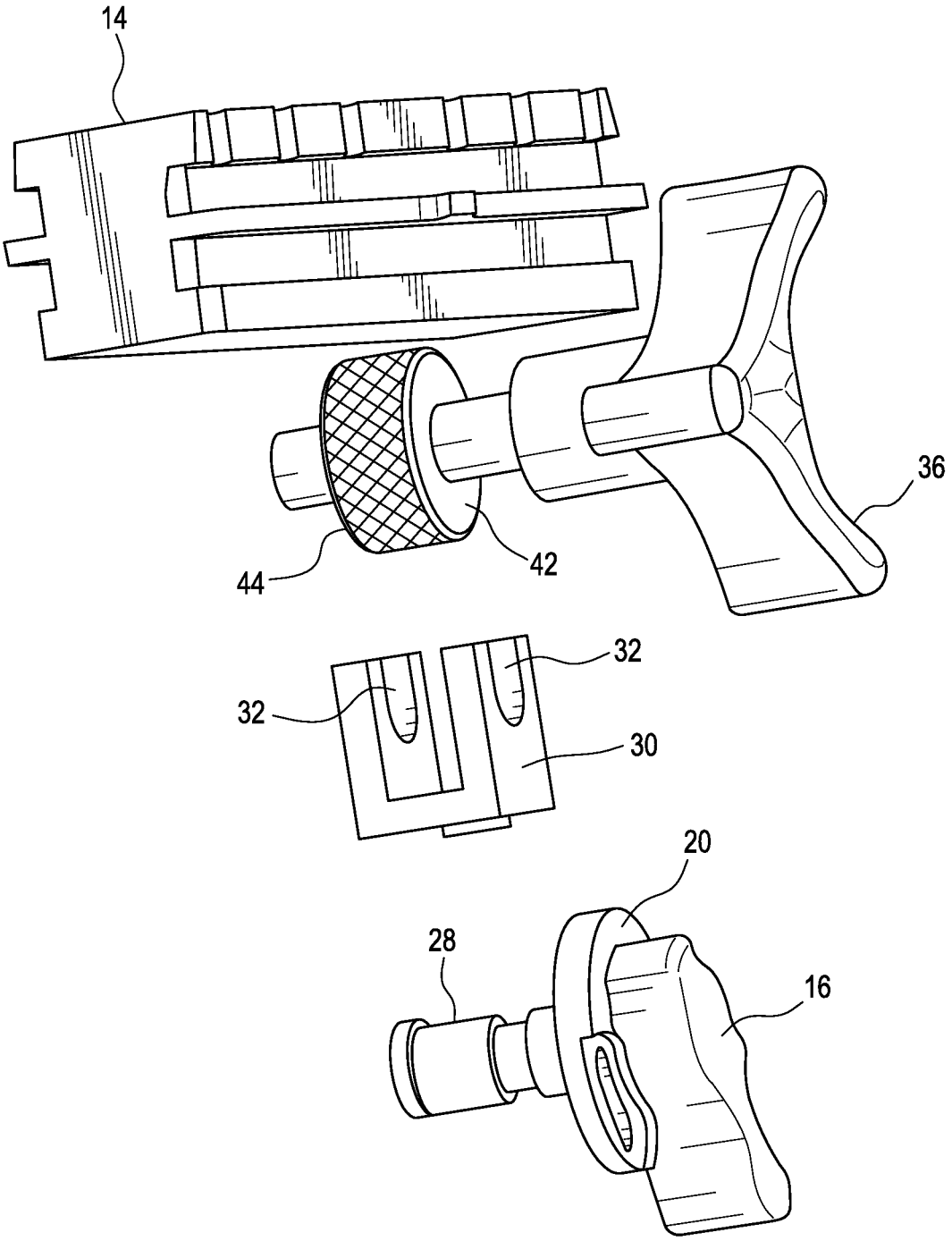
FIG. 4 is an exploded sectional view of the tension adjustment assembly.

As shown more particularly in FIG. 3, the elevation base 8 includes in its upper surface a slot 10 and opposed channels 12 for receiving an elevation rail as will be developed below. A tension adjustment assembly is connected with the elevation base to adjust the tension between the rail and the base. The tension adjustment assembly will be described with reference to FIGS. 3-9. The elevation rail 14 is shown in FIGS. 4 and 7-9.

The tension adjustment assembly includes a tension lever 16 which passes through a central opening 18 in an adjustment plate 20 and into an aligned opening 22 in the lower portion of the elevation base 8. The adjustment plate is connected with the base 8 via a screw (not shown) which passes through a slot 24 in the adjustment plate and engages a threaded opening 26 in the elevation base. The tension lever 16 includes a cam surface 28.

The tension adjustment assembly also includes a yoke 30 arranged in the elevation base 8 beneath the slot 10. The yoke contains a pair of channels 32 in the upper surface for supporting a shaft 34 of an elevation knob 36 which is used to displace the elevation rail 14 relative to the elevation base as will be described below. The shaft 34 includes a raised portion 38 which provides an interference fit with an axial opening 40 in a traction wheel 42. The yoke channels 32 support the portions of the shaft 34 on opposite sides of the traction wheel 42.

Referring now to FIGS. 4 and 7-9, the traction wheel 42 is arranged beneath the lower surface of the elevation rail 14. The elevation rail is formed of a synthetic plastic material such as Delrin® material which is rigid but also deformable or imprintable. The traction wheel has a knurled surface 44 (best shown in FIG. 3) which abuts against the lower surface of the elevation rail. Through use, the knurls or projections of the traction wheel form an embedded pattern on the elevation rail lower surface. The elevation rail 14 includes projections 46 on either side which are received in the channels 12 of the elevation base 8 when the rail is arranged in the slot 10 in the top of the base. The rail 14 is linearly displaced relative to the elevation base 8 by the user rotating the elevation knob 36 to in turn rotate the traction wheel 42. Rotation of the knob in opposite directions slides the elevation rail within the slot in the elevation base.

Figure 5A:
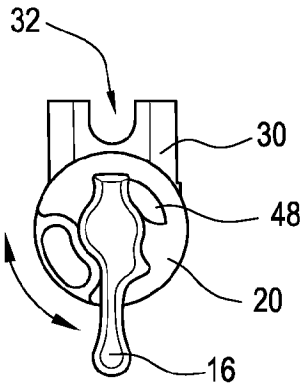
FIGS. 5A and 5B are front plan views of the tension lever of the tension adjustment assembly in high and low pressure positions, respectively.
Figure 5B:
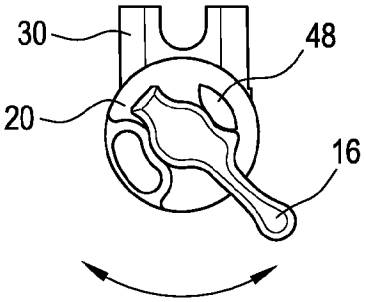
Figure 6:
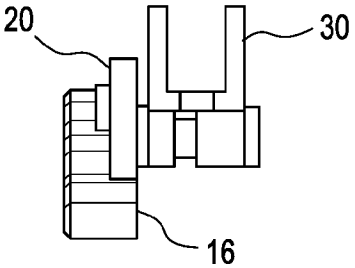
FIG. 6 is a side view of the tension lever shown in FIGS. 5A and 5B.
Figure 7:
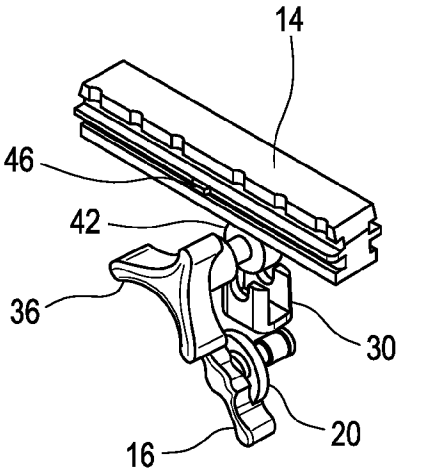
FIGS. 7 and 8 are front perspective and plan views, respectively, showing the tension adjustment assembly adjacent to an elevation rail of the elevation adjustment assembly of FIG. 1.
Figure 8:
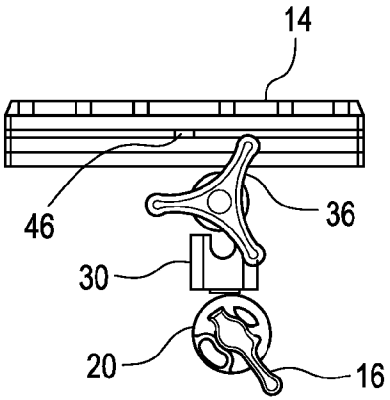
Figure 9:
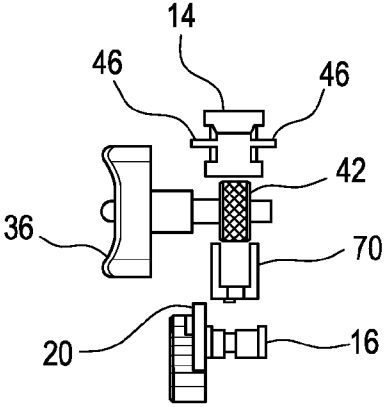
FIG. 9 is an exploded side view showing the tension adjustment assembly and the elevation rail.

The tension adjustment assembly increases or decreases the force applied by the traction wheel 42 against the elevation rail 14, thereby varying the tension between the rail and the base 8 in accordance with the user's preference. Rotation of the tension lever 16 in opposite directions rotates the cam surface 28, which abuts against the bottom of the yoke as shown in FIG. 6, to raise and lower the yoke which in turn raises and lowers the shaft 34 of the elevation knob 36, thus raising and lowering the traction wheel 42. The range of rotation of the tension lever is limited by a projection 48 on the adjustment plate 20. In FIG. 5A, the tension lever has been rotated clockwise until it abuts the projection in a position where the cam raises the yoke and applies the highest pressure of the traction wheel against the rail, effectively acting as a stop and preventing movement of the rail. In FIG. 5B, the tension lever has been rotated counter clockwise until it abuts the projection in a position where the cam lowers the yoke and the minimal pressure is applied by the traction wheel against the rail.

Through use, the traction wheel 42 creates an impression in the lower surface of the elevation rail that provides a repeated tracking relationship that remains consistent when turning the elevation knob 36 in opposite directions. After wear from use over an extended period of time, the adjustment plate 20 can be adjusted relative to the elevation base to allow the tension lever to be rotated farther in the clockwise direction to press the traction wheel even further into the lower surface of the rail renewing an impression or footprint in the rail for greater traction and quality of operation.

Figure 10:
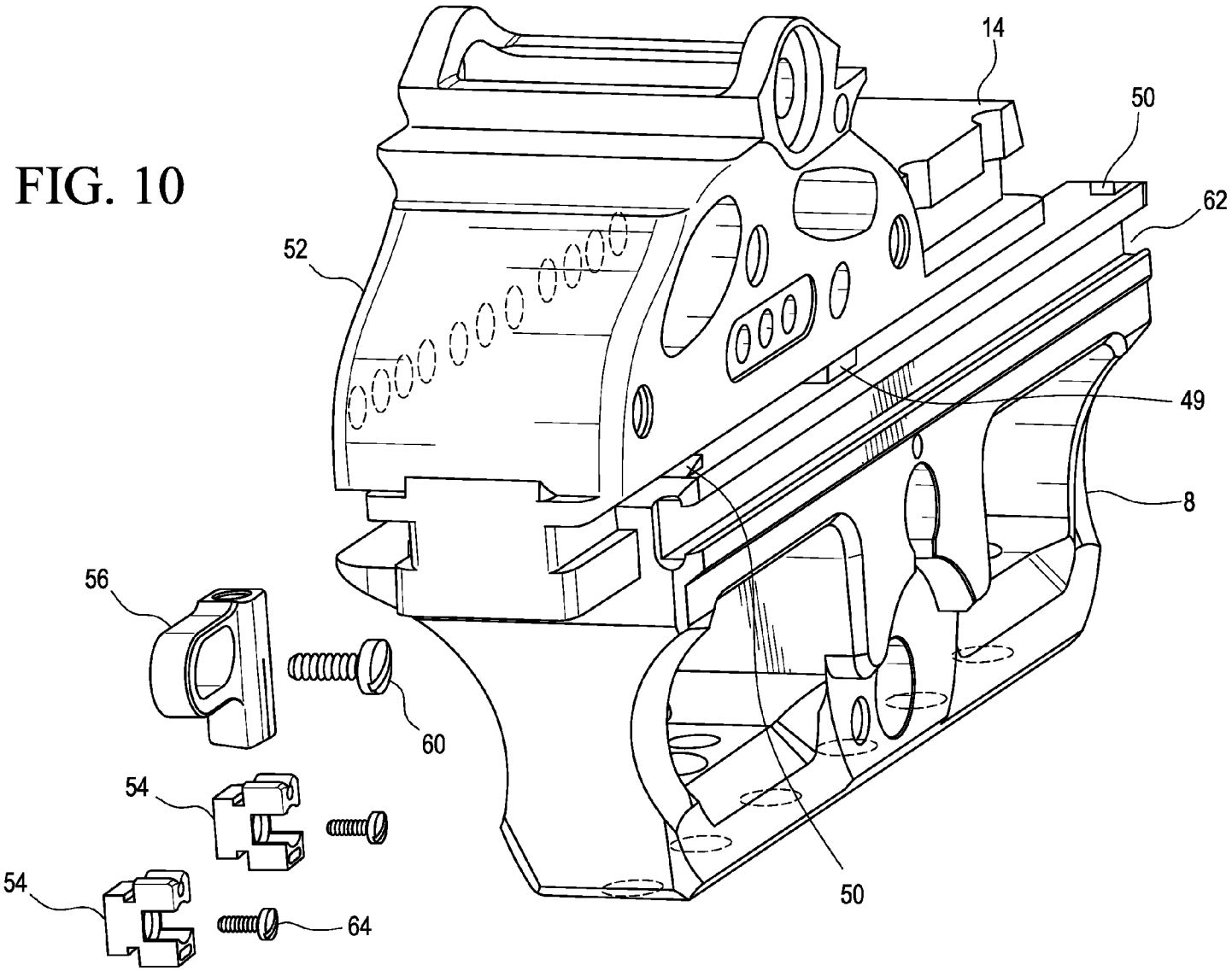
FIG. 10 is an exploded perspective view of the assembled elevation carriage mounted on the elevation rail and the detent system.

Referring now to FIG. 10, the elevation rail 14 is shown connected with the elevation base 8. As set forth above, the rail slides relative to the base within a slot in the top of the base. In order to prevent the rail from sliding out of the slot and separating from the base, the rail includes a projection 49 on either side which extends above the top surface of the base. The base top surface includes ramps or stops 50 at each end. The ramps engage the projection on the rail to prevent the rail from extending beyond either end of the slot in the base.

Also shown in FIG. 10 is an elevation carriage 52 which is connected with the top of the elevation rail 14. Thus, the elevation carriage moves with the rail relative to the base.

Figure 11:
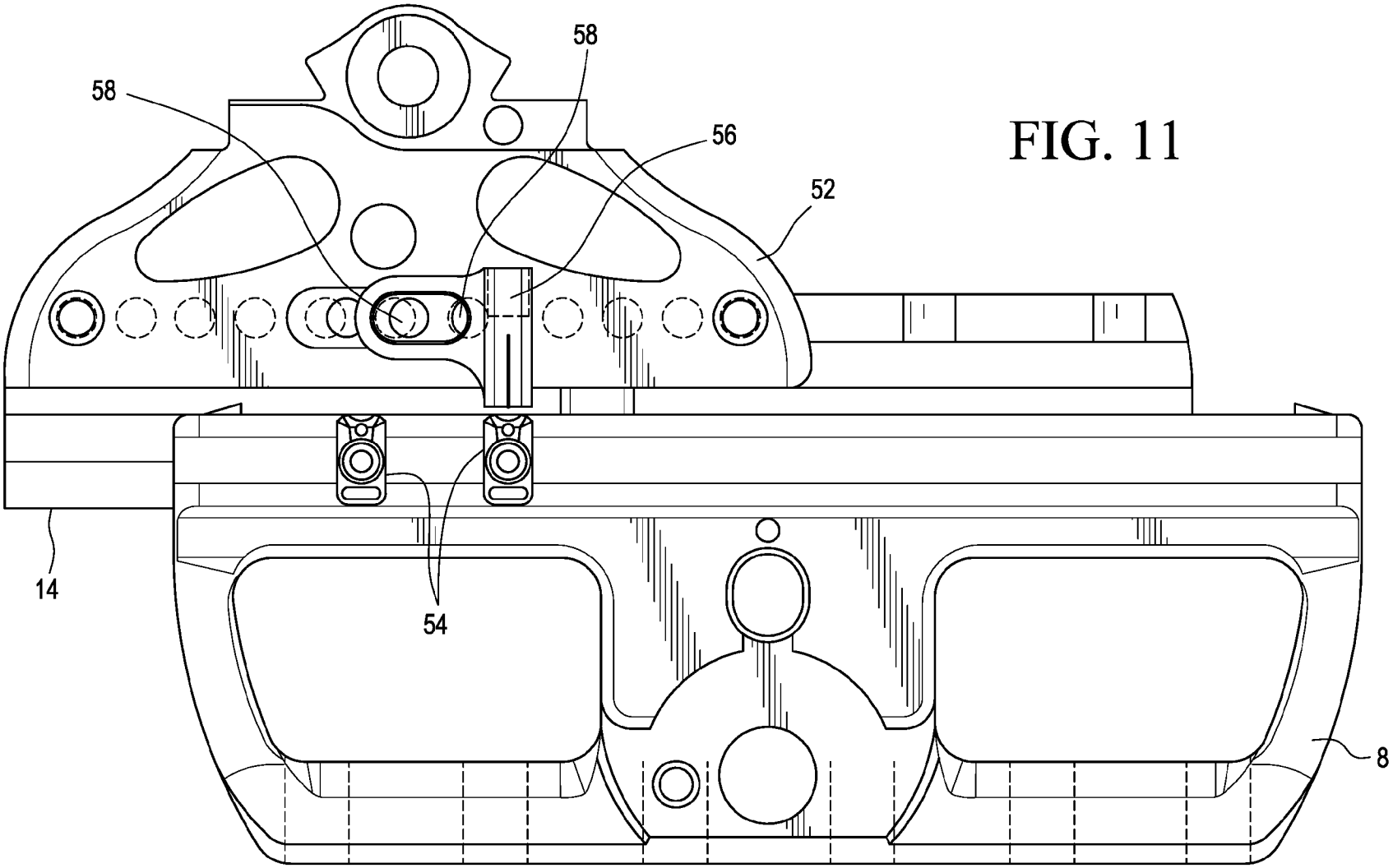
FIG. 11 is a side plan view of the assembled elevation carriage, elevation rail, elevation base and detent system.

In addition to the ramps or stops 50 which limit the linear displacement of the rail at the ends of the base slot, an adjustable stop assembly is provided which can be set by the user to stop the elevation rail and carriage at selected locations relative to the elevation base. The stop assembly includes at least one detent 54 and at least one housing 56 which contains a spring biased ball. The housing is connected with one of a plurality of openings 58 in the sides of the elevation carriage by a screw 60 or other suitable fastener. A housing may be provided on both sides of the elevation carriage, if desired. The detent is connected with the side of the elevation base. As shown in FIGS. 10 and 11, the sides of the elevation base contain slots or channels 62 which are configured to receive the detent 54. A screw such as a set screw 64 passes through an opening in the detent and engages an inner wall which defines the slot. Tightening of the screw locks the detent in the selected position which corresponds to a desired elevation of the sight as determined by the user. The detent can be repositioned by loosening the set screw and sliding the detent to a new elevation position and then re-tightening the set screw. Preferably, a plurality of detents are provided so that multiple elevations can be set by the user.

Figure 12:
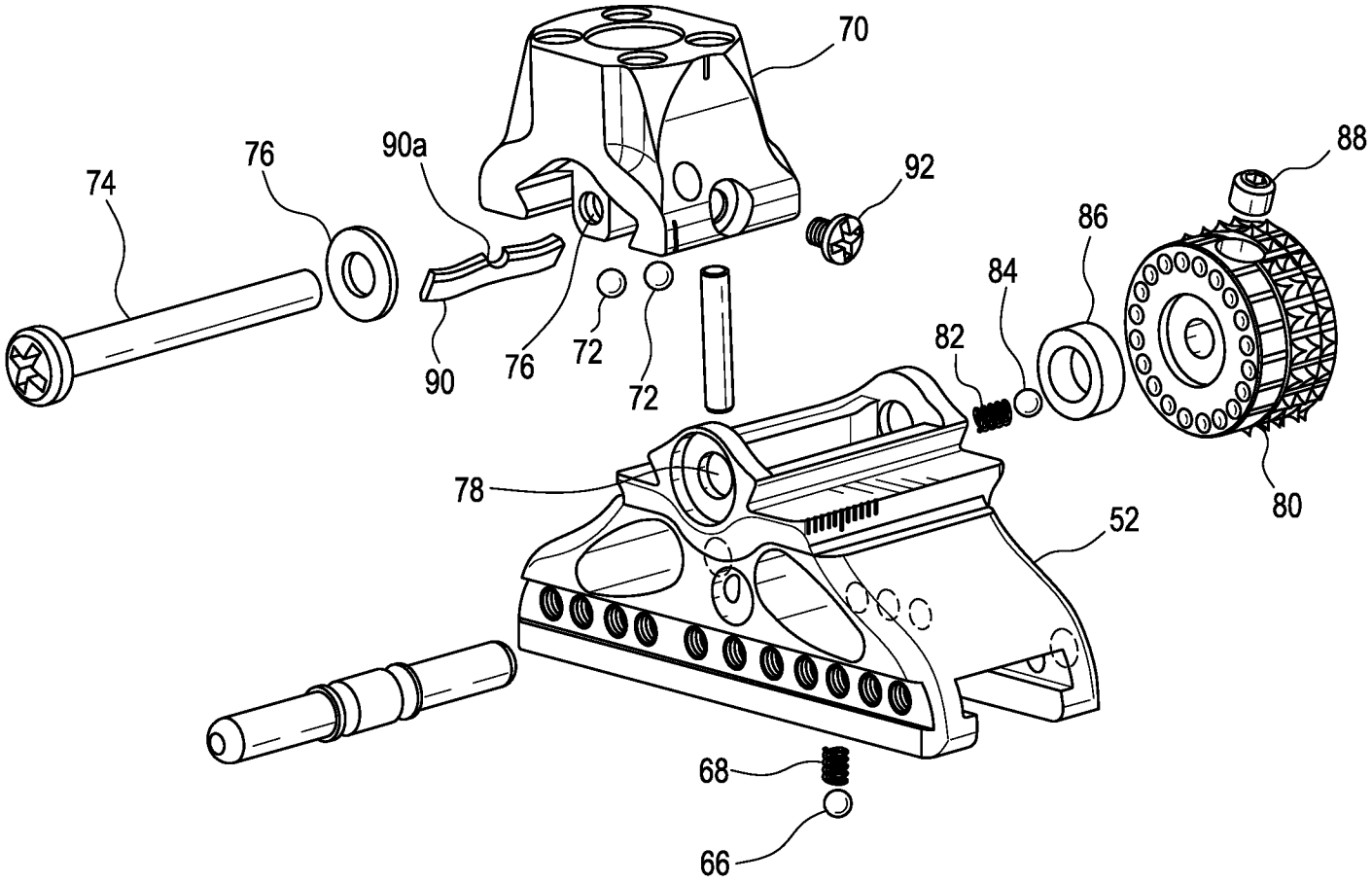
FIGS. 12 and 13 are exploded perspective views, respectively, showing the connection between the windage carriage and the elevation carriage of the elevation adjustment assembly.

As noted above, each housing 56 contains a ball 66 and a spring 68 which are shown in FIG. 12, the spring biasing the ball toward an extended position. As the elevation rail and elevation carriage are displaced relative to the elevation base by rotation of the elevation knob and the traction wheel, the ball in the housing under the force of the spring engages a detent to stop the movement of the rail in the selected position. The spring force is not so great that the rail can not be moved to another elevation position as set by the user. The ball and detent stop assembly is sufficient however to position the elevation carriage and sight in the selected elevation location.

Figure 13:
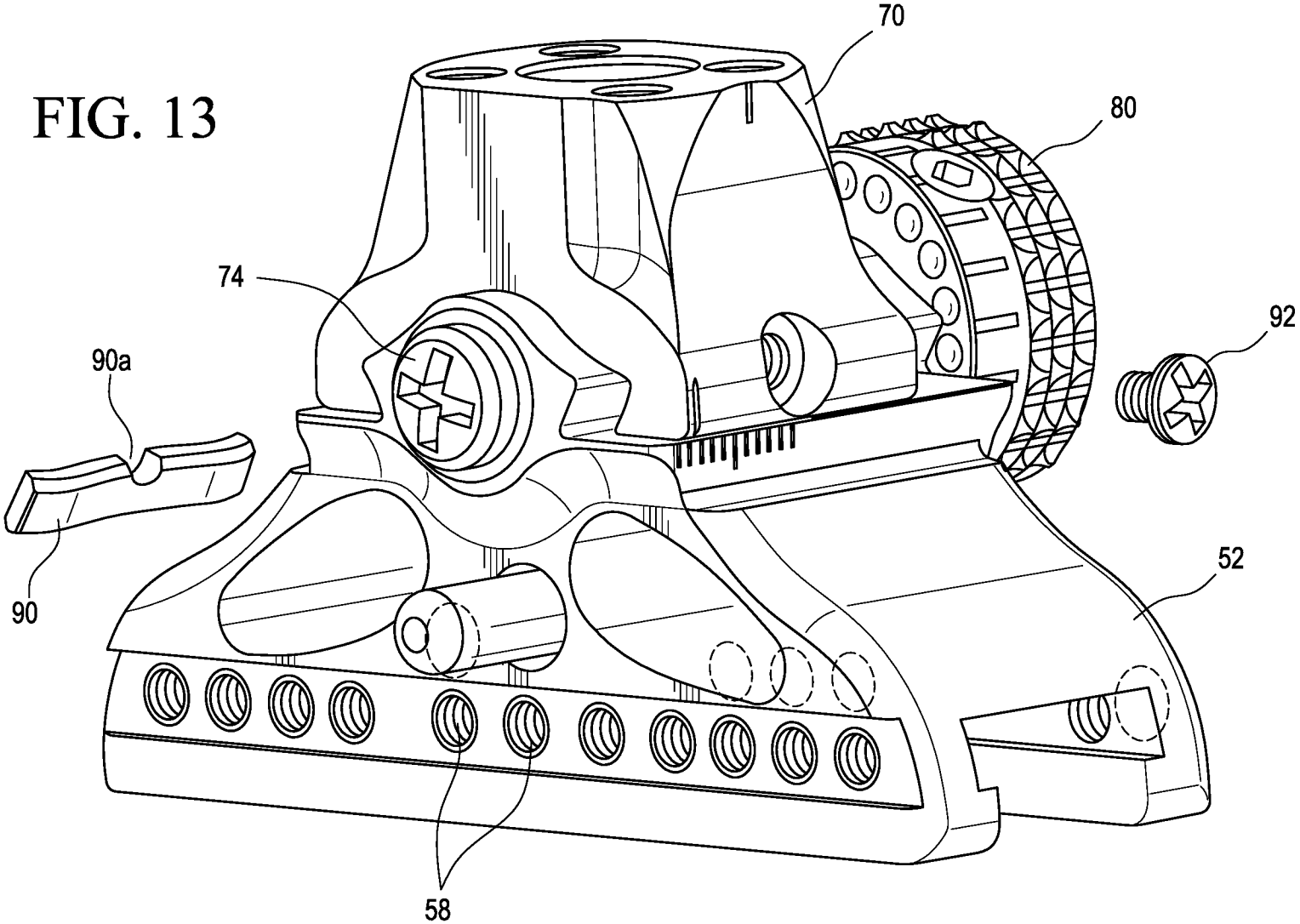

FIGS. 12 and 13 illustrate the connection of a windage carriage 70 to the elevation carriage. The windage carriage provides adjustment of the sight in a direction normal to the elevation adjustment of the carriage relative to the elevation base.

The windage carriage 70 includes two recesses (not shown) in the central bottom region of the carriage. The recesses receive two synthetic plastic ball bearings 72. The bearings are preferably formed of Delrin® material. The windage 70 and elevation 52 carriages are configured to mate via dovetails on the elevation carriage. A screw 72 passes through a washer 74 and through aligned openings 76 and 78 in the windage carriage and elevation carriage, respectively. The opening 76 in the windage carriage is threaded whereas the openings in the elevation carriage are not. Thus, rotation of the screw displaces the windage carriage along the screw relative to the elevation carriage.

In order for the user to manually rotate the screw 74, a knob 80 is connected with the free end of the screw opposite the head end thereof. A spring 82 and steel ball 84 are arranged between the knob 80 and the windage carriage. A washer 86 is arranged on the free end of the screw to which the knob is attached. A synthetic plastic ball (not shown) is arranged in a tapped hole in a side surface of the knob and held in place by a set screw 88. Rotation of the knob 80 incrementally displaces the windage carriage along the screw relative to the elevation carriage.

A unique feature of the connection of the windage carriage and the elevation carriage is the use of a contoured or wavy windage gib 90 between the windage carriage and the dovetail portion of the elevation carriage as shown in FIG. 30. The upper surface of the windage gib contains a recess 90*a* intermediate the ends of the gib. When the windage gib is slid into the gap between the dovetail portion of the elevation carriage and the windage carriage, the gib is held in place by a retainer screw 92 which passes into a threaded opening in the windage carriage. The windage gib is formed of a resilient material such as Delrin® AF material which is a synthetic plastic material. The spring activation of the windage gib allows for the Delrin® AF material tensile strength displacement to provide the necessary tension between the windage carriage and the elevation carriage. This eliminates the need for an adjustment screw to vary the tension.

FIGS. 1 and 2 show a sight 94 connected with the windage carriage via a sight mount 96. The sight is adjustable in three dimensions: vertically by adjusting the elevation carriage relative to the elevation base; laterally by adjusting the windage carriage relative to the elevation carriage; and rotationally by adjusting the sight mount 96 relative to the windage carriage.

While the preferred forms and embodiments of the invention have been illustrated and described, it will be apparent to those of ordinary skill in the art that various changes and modifications may be made without deviating from the inventive concepts set forth above.

What is claimed is:

1. A sight elevation assembly for a bow, comprising a base connected with the bow, a rail slidably connected with said base, and an assembly for varying the tension between said base and said rail, said variable tension assembly comprising a tension lever connected with said base and having a cam surface engaging said rail, whereby rotation of said tension lever is operable to vary the tension and lock said rail in a selected position relative to said base.

2. A sight elevation assembly for a bow, comprising an assembly for varying the tension of the elevation assembly, said variable tension assembly comprising a tensions lever having a cam surface and a yoke connected with said elevation assembly, said cam surface engaging said yoke, whereby rotation of said tension lever in opposite directions displaces said yoke to increase and decrease tension applied to the elevation assembly, respectively.

3. A sight elevation assembly as defined in claim 2, wherein said variable tension assembly further comprises an adjustment plate which receives said tension lever and controls the range of rotation of said tension lever for limiting rotation of said tension lever between low and high tension positions, respectively.

4. A sight elevation assembly as defined in claim 3, and further comprising a base and a rail slidably connected with said base for linear movement along said base, said tension assembly being connected between said rail and said base to vary the tension between said rail and said base.

5. A sight elevation assembly as defined in claim 4, and further comprising a drive mechanism connected with said base for displacing said rail.

6. A sight elevation assembly as defined in claim 5, wherein said drive mechanism includes a traction wheel supported by said yoke and engaging a portion of said rail, whereby rotation of said traction wheel displaces said rail relative to said base.

7. A sight elevation assembly as defined in claim 6, wherein said drive mechanism further includes a knob having a pin connected with said traction wheel for manual rotation of said wheel to displace said rail.

8. A sight elevation assembly as defined in claim 7, wherein said tension wheel has a knurled surface and said rail is formed of a synthetic plastic material which is imprinted by said tension wheel surface when said tension wheel is pressed against a surface of said rail.

9. A sight elevation assembly as defined in claim 4, and further comprising an adjustable stop assembly for stopping said elevation rail in at least one predetermined position relative to said elevation base.

10. Apparatus as defined in claim 9, wherein said stop assembly includes at least one detent adjustably connected with said base and at least one housing adjustably connected with said rail, said housing containing a spring-biased ball assembly which engages said at least one detent.

11. Apparatus as defined in claim 4, wherein said rail includes at least one lateral protrusion and said base contains a ramp at each end thereof, said ramps and said protrusion cooperating to prevent said rail from sliding beyond the ends of said base.

12. Apparatus for adjusting the elevation of a sight on a bow, comprising (a) an elevation base connected with the bow;

(b) a carriage for the sight slidably connected with the elevation base for linear displacement relative to said elevation base; and (c) a stop assembly connected with said base and said carriage for retaining said carriage in at least one linear position relative to said elevation base corresponding to a desired elevation of the sight, said stop assembly including at least one detent adjustably connected with said elevation base and at least one housing adjustably connected with said carriage, said housing containing a spring-biased ball assembly which engages said at least one detent.

13. Apparatus for adjusting the elevation of a sight on a bow, comprising (a) an elevation base connected with the bow;

(b) a carriage for the sight slidably connected with the elevation base for linear displacement relative to said elevation base;

(c) at least one detent adjustably connected with said base and said carriage; and (d) a housing adjustably connected with each side of said carriage, each housing containing a spring-biased ball assembly which engages at least one of said detents for retaining said carriage in at least one linear position relative to said elevation based corresponding to a desired elevation of the sight.

14. Apparatus as defined in claim 13, wherein a plurality of detents are connected with said elevation base on each side of said carriage at predetermined spaced locations corresponding with selected elevation positions of the sight.

15. Apparatus as defined in claim 14, wherein said elevation base contains a pair of longitudinal slots in upper side wall portions thereof on opposite sides of said carriage, said detents being arranged in said slots and including screws which are operable to fix said detents in said predetermined spaced locations.

16. Apparatus as defined in claim 15, wherein each side of said carriage contains a plurality of longitudinally spaced openings and said housings contain a slot, said housings being connected with said carriage by screws which pass though said housing slots to engage one of said openings, respectively.

* * * * *